US009025997B2

(12) United States Patent
Yokoi

(10) Patent No.: US 9,025,997 B2
(45) Date of Patent: May 5, 2015

(54) IMAGE FORMING APPARATUS HAVING DETACHABLY MOUNTED PROCESS CARTRIDGE AND FIXED EXPOSURE DEVICE

(75) Inventor: Junichi Yokoi, Toyoake (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 190 days.

(21) Appl. No.: 13/362,103

(22) Filed: Jan. 31, 2012

(65) Prior Publication Data

US 2012/0230724 A1 Sep. 13, 2012

(30) Foreign Application Priority Data

Mar. 10, 2011 (JP) ..... 2011-052494

(51) Int. Cl.

| | |
|---|---|
| ***G03G 21/18*** | (2006.01) |
| ***G03G 15/04*** | (2006.01) |
| ***G03G 21/16*** | (2006.01) |

(52) U.S. Cl.

CPC ..... *G03G 15/04054* (2013.01); *G03G 21/1633* (2013.01); *G03G 21/1666* (2013.01); *G03G 21/1853* (2013.01)

(58) Field of Classification Search

CPC ..... G03G 21/1853; G03G 21/1842; G03G 2221/1869; G03G 2221/1884; G03G 21/1642; G03G 21/1647; G03G 2221/1636; G03G 21/1666; G03G 2215/1409

USPC ..... 399/111, 118; 347/242, 245, 138, 257

See application file for complete search history.

(56) References Cited

U.S. PATENT DOCUMENTS

| | | | | |
|---|---|---|---|---|
| 5,745,823 | A * | 4/1998 | Goto et al. | 399/111 |
| 5,808,649 | A | 9/1998 | Shimanari et al. | |
| 5,873,012 | A * | 2/1999 | Miyabe et al. | |
| 5,878,309 | A * | 3/1999 | Nomura et al. | 399/111 |

(Continued)

FOREIGN PATENT DOCUMENTS

| | | | |
|---|---|---|---|
| JP | 05072831 | A * | 3/1993 |
| JP | H05-249767 | A | 9/1993 |
| JP | H09-160333 | A | 6/1997 |
| JP | 2000321843 | A * | 11/2000 |
| JP | 2001-209220 | A | 8/2001 |
| JP | 2007-140392 | A | 6/2007 |
| JP | 2009-162907 | A | 7/2009 |
| JP | 2009-265128 | A | 11/2009 |
| JP | 2010-072588 | A | 4/2010 |

OTHER PUBLICATIONS

Japan Patent Office, Notification of Reasons for Refusal for Japanese Patent Application No. 2011-052494 (counterpart Japanese patent application), dispatched Feb. 19, 2013.

*Primary Examiner* — Walter L Lindsay, Jr.
*Assistant Examiner* — Milton Gonzalez
(74) *Attorney, Agent, or Firm* — Merchant & Gould PC

(57) ABSTRACT

An image forming apparatus includes a main body; a process cartridge being detachably mounted to the main body along a direction perpendicular to a rotational axis direction, the process cartridge including a photosensitive member, and a charger facing a surface of the photosensitive member; and an exposure device including a plurality of light emitting devices arranged along the rotational axis direction, and a facing part. The facing part is a part of the exposure device that is positioned closest to the photosensitive member and faces the surface of the photosensitive member when seen from the rotational axis direction, at a state in which the process cartridge is mounted, and the charger is positioned at an opposite side of the exposure device with respect to a second line which is parallel with the mounting direction and passes the facing part when seen from the rotational axis direction.

9 Claims, 15 Drawing Sheets

(56) References Cited

U.S. PATENT DOCUMENTS 6,014,531 A * 1/2000 Ebata et al.
6,055,006 A * 4/2000 Murano ..... 347/118
7,777,769 B2 * 8/2010 Nozawa
8,207,995 B2 * 6/2012 Tamaru et al. ..... 347/242
8,576,265 B2 * 11/2013 Tamaru et al. ..... 347/138
2007/0115340 A1 5/2007 Tanabe
2008/0152386 A1 * 6/2008 Sakaguchi et al.
2009/0175653 A1 7/2009 Kamimura
2009/0190953 A1 * 7/2009 Okabe ..... 399/111
2010/0074648 A1 3/2010 Kondo

* cited by examiner

IMAGE FORMING APPARATUS HAVING DETACHABLY MOUNTED PROCESS CARTRIDGE AND FIXED EXPOSURE DEVICE

CROSS-REFERENCE TO RELATED APPLICATIONS

This application claims priority from Japanese Patent Application No. 2011-052494 filed on Mar. 10, 2011, the entire contents of which are incorporated herein by reference.

TECHNICAL FIELD

The invention relates to an image forming apparatus.

BACKGROUND

In an image forming apparatus of an electrophotographic type, a photosensitive drum, for example, is uniformly charged by a charger. The charged surface of the photosensitive drum is exposed by light from an exposure device, so that an electrostatic latent image is formed thereon. The electrostatic latent image on the surface of the photosensitive drum becomes a developer image as developers are supplied thereto. After that, the developer image is transferred onto a sheet.

In the image forming apparatus, as the exposure device, there has been known an exposure device having an exposure head. Also, an image forming apparatus has been known in which a process cartridge having a photosensitive drum is detachably mounted to the image forming apparatus. The exposure head has a plurality of light emitting devices consisting of organic EL (Electro Luminescent) devices or LEDs (Light Emitting Diodes) and lenses, which are arranged in an array shape on a part facing a surface of the photosensitive drum. The lights from the light emitting devices are imaged on the surface of the photosensitive drum by the lenses, so that an electrostatic latent image is formed on the surface of the photosensitive drum.

Since the exposure head has a short lens focal length, it is necessary to arrange the exposure head adjacent to the surface of the photosensitive drum. Therefore, the exposure head may interfere with the attaching and detaching operations of the process cartridge.

Accordingly, related-art describes a configuration in which the exposure head (LED array head) is contacted and separated to and from the photosensitive drum in conjunction with opening and closing operations of an exterior cover provided to a front face of an apparatus main body. Specifically, the LED array head is fixed to an upper end portion of an arm-shaped holder that extends in an upper-lower direction. The arm-shaped holder is rotatably mounted to the apparatus main body. As the arm-shaped holder is rotated in conjunction with opening and closing operations of a top cover, the LED array head of the holder is contacted and separated to and from the photosensitive drum.

SUMMARY

However, as described in the related-art, when it is configured that the LED array head is contacted and separated to and from the photosensitive drum in conjunction with the moving of the top cover, a configuration of the apparatus main body becomes complicated.

Accordingly, an object of the invention is to provide an image forming apparatus using an exposure head in which a process cartridge can be attached and detached with a simple configuration.

According to an aspect of the invention, there is provided an image forming apparatus including: a main body; a process cartridge being detachably mounted to the main body along a direction perpendicular to a rotational axis direction which is a direction of a rotation axis of a photosensitive member, the process cartridge including, the photosensitive member, and a charger facing a surface of the photosensitive member and charging the surface of the photosensitive member; and an exposure device that exposes the photosensitive member at a state in which the process cartridge is mounted, the exposure device including, a plurality of light emitting devices arranged along the rotational axis direction, and a facing part, wherein the charger is arranged to be adjacent to the photosensitive member at a downstream side with respect to a mounting direction of the process cartridge, wherein the exposure device is positioned on a first line, which intersects with the rotation axis and is perpendicular to the mounting direction when seen from the rotational axis direction, at a state in which the process cartridge is mounted, wherein the facing part is a part of the exposure device that is positioned closest to the photosensitive member and faces the surface of the photosensitive member when seen from the rotational axis direction, at a state in which the process cartridge is mounted, and wherein the charger is positioned at an opposite side of the exposure device with respect to a second line which is parallel with the mounting direction and passes the facing part when seen from the rotational axis direction.

DETAILED DESCRIPTION

<Overall Configuration of Printer>

Figure 1:
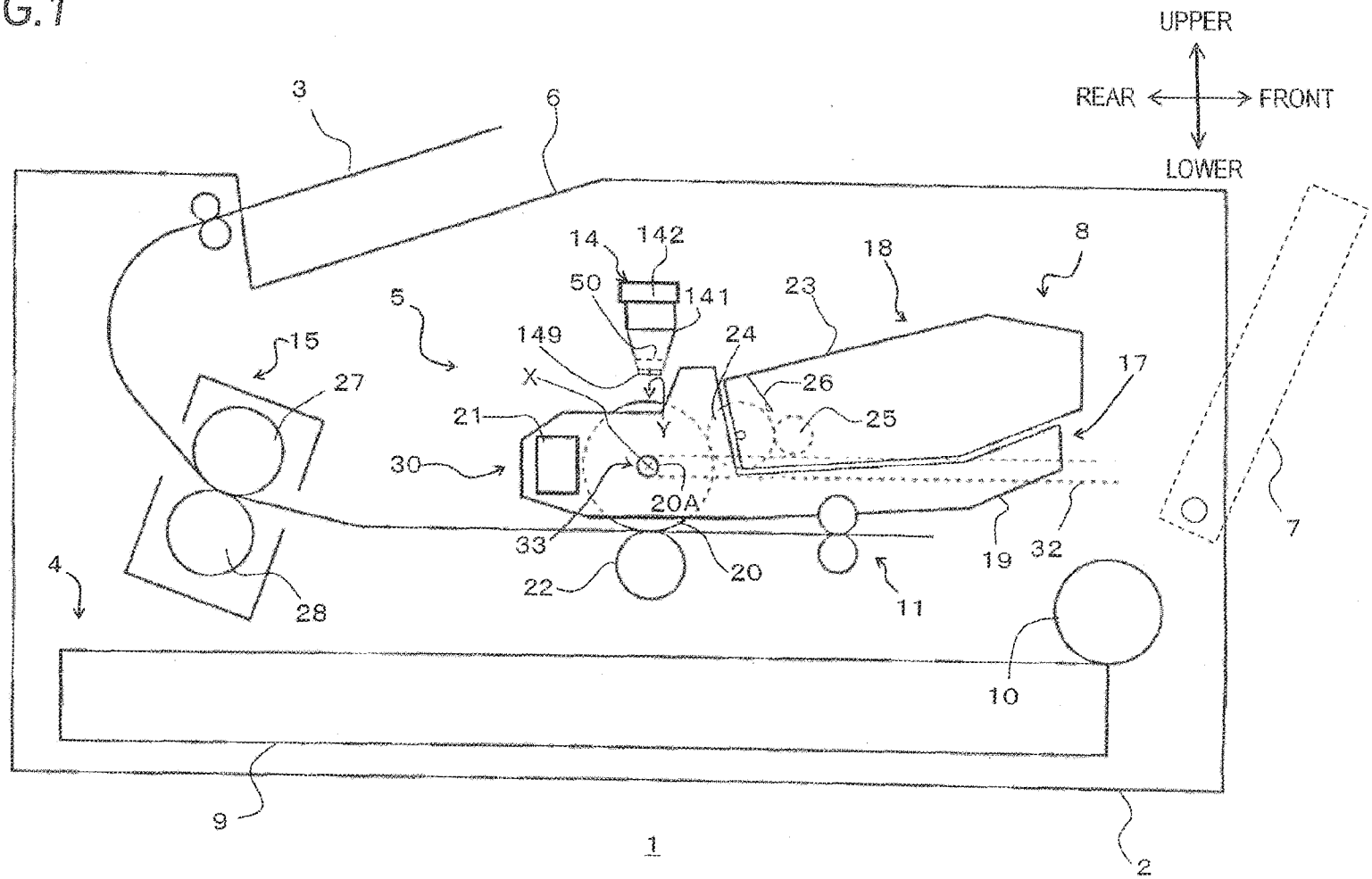
FIG. 1 is a schematic side sectional view of a printer.

FIG. 1 is a schematic sectional view of a printer that is an example of the image forming apparatus of the invention.

As shown in FIG. 1, the printer 1 has a box-shaped body casing 2 that is long in the front-rear direction, which is an example of the apparatus main body. The body casing 2 is provided therein with a feeder unit 9 that feeds a sheet 3, which is an example of the recording medium, an image forming unit 5 that forms an image on the fed sheet 3 and a sheet discharge part 6 that discharges the sheet having an image formed thereon.

As shown in FIG. 1, a cover 7 is provided on one side face of the body casing 2 so that it can be opened and closed. The body casing 2 has therein a mounting part 30 that detachably mounts a process cartridge 8, which will be described later, thereto. The mounting part 30 has sidewalls 31 (see FIG. 2) that are arranged so as to interpose the process cartridge 8 therebetween in the left-right direction in the body casing. The process cartridge 8 is detachably mounted to the mounting part 30 with the cover 7 being opened.

Meanwhile, in the descriptions hereinafter, the side at which the cover 7 is provided is referred to as the front side (front face side) and the opposite side thereto is referred to as the back side (rear surface side). Also, the left and right sides corresponds to the left and right sides of the printer 1 when seeing the printer 1 from the front side. The process cartridge 8 is described in relation to a mounting direction thereof to the body casing 2, unless otherwise noted.

As shown in FIG. 1, the feeder unit 4 has a sheet feeding tray 9 that stacks and accommodates the sheets 3, a sheet feeding roller 10 and register rollers 11.

The sheets 3 are delivered one by one to the register rollers 11 by rotation of the sheet feeding roller 10. The sheet 3 is registered by the register rollers 11 and then conveyed toward the image forming unit 5 (between a photosensitive drum 20 and a transfer roller 22).

The image forming unit 5 has an exposure unit 14 that is an example of the exposure device, the process cartridge 8 and a fixing unit 15.

The exposure unit 14 is arranged at an upper part in the body casing 2. The exposure unit 14 has an LED array head 141 that is an example of the exposure head and a head support member 142 that supports the LED array head 141.

The LED array head 141 has LED devices 50, which are an example of the light emitting device, and a lens array 149 that is an example of the facing part. The LED devices 50 whose number depends on the resolution of the printer 1 are arranged in the left-right direction.

The lens array 149 is provided below the LED devices 50 and at a position at which the lens array faces the photosensitive drum 20. The lens array 149 generates an image on the surface of the photosensitive drum 20 in accordance with lights Y emitted from the respective LED devices 50. A part of the lens array 149 facing the photosensitive drum 20 is formed with a facing surface 149A (refer to FIG. 2). In this illustrative embodiment, the facing surface extends along the front-rear direction.

The LED array head 141 is arranged above the photosensitive drum 20, which is an example of the photosensitive member, at a predetermined interval so that it faces the photosensitive drum, at a state in which the process cartridge 8 has been mounted to the body casing 2. The distance between the lens array 149 and the surface of the photosensitive drum 20 is about 2 to 3 mm.

In this illustrative embodiment, an exposure position means a positional relation of the LED array head 141 and the photosensitive drum 20 at which the LED array head 141 can form an electrostatic latent image on the surface of the photosensitive drum 20, at a state in which the process cartridge 8 has been completely mounted to the mounting part 30. That is, the exposure position indicates a positional relation of the LED array head 141 and the photosensitive drum 20 shown in FIG. 1.

The process cartridge 8 has a drum cartridge 17 and a developing cartridge 18 that is detachably mounted to the drum cartridge 17.

The drum cartridge 17 has a drum frame 19, the photosensitive drum 20 and a scorotron-type charger 21 that is an example of the charger. The photosensitive drum 20 is mounted to the drum frame 19 so that it can be rotated about a rotational axis (center of rotation) of a rotational shaft 20A extending in the left-right direction. The rotational shaft 20A protrudes outward in the left-right direction from the drum frame 19.

A lower outer periphery of the photosensitive drum 20 is exposed downward from a bottom surface of the drum frame 19. As shown in FIG. 1, the lower outer periphery of the photosensitive drum 20 is arranged to contact the transfer roller 22. The transfer roller 22 is mounted in the body casing 2 so that it can be rotated about a central shaft extending in the left-right direction.

Figure 3:
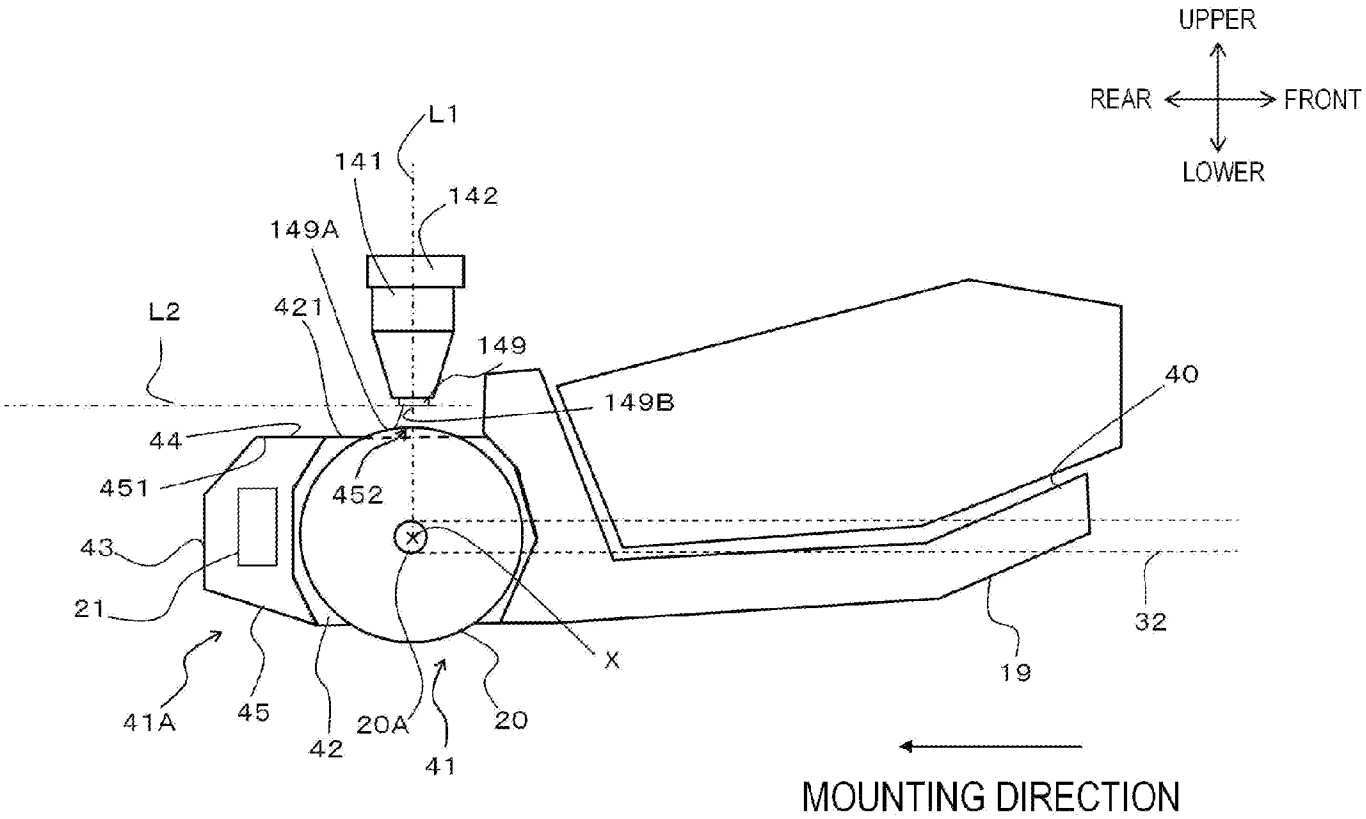
FIG. 3 is a schematic enlarged side sectional view of the process cartridge and the exposure unit.

The photosensitive drum 20 has a drum-side facing part 452 that is an upper part of the photosensitive drum 20 and faces the lens array 149 (refer to FIG. 3). The scorotron-type charger 21 is arranged downstream from the photosensitive drum 20 with respect to the mounting direction of the process cartridge 8.

The developing cartridge 18 has a developing casing 23 that is an example of the developer accommodation part, a developing roller 24, a supply roller 25 and a layer thickness regulation blade 26. The developing roller 24 and the supply roller 25 are supported to the developing case 23 so that they can be rotated about central shafts thereof extending in the left-right direction.

The developing casing 23 accommodates therein toners. The toners are supplied to the supply roller 25 and then to the developing roller 24 from the supply roller 25 when forming an image. At this time, the toners are positively friction-charged between the supply roller 25 and the developing roller 24. The toners on the developing roller 24 are made into a thin layer by the layer thickness regulation blade 26 as the developing roller 24 rotates.

In the meantime, the surface of the photosensitive drum 20 is positively charged uniformly by a corona discharge of the scorotron-type charger 21. The positively charged surface of the photosensitive drum 20 is scanned by the light from the exposure unit 14, so that an electrostatic latent image is formed thereon.

When the electrostatic latent image formed on the surface of the photosensitive drum 20 faces the developing roller 24 as the photosensitive drum 20 rotates, the toners carried on the developing roller 24 are supplied to the electrostatic latent image. Thereby, the electrostatic latent image becomes a visible image and thus a toner image, which is an example of the developer image, is carried on the surface of the photosensitive drum 20.

The toner image is transferred to the sheet 3, which is conveyed between the photosensitive drum 20 and the transfer roller 22, by a transfer bias that is applied to the transfer roller 22. The sheet 3 having the toner image transferred thereon as described above is conveyed toward the fixing unit 15.

The fixing unit 15 is provided at the rear of the process cartridge 8. The fixing unit 15 has a heating roller 27 and a pressing roller 28 that contact each other. The toner image transferred on the sheet 3 is fixed on the sheet 3 while the sheet passes between the heating roller 27 and the pressing roller 28.

Also, the sidewalls 31 of the mounting part 30 are formed with guide recesses 32 that are an example of the guide part that guides the process cartridge 8 in the front-rear direction with respect to the rotational shaft 20A when attaching and detaching the process cartridge 8. The guide recesses 32 linearly extend rearward from front ends of the sidewalls 31.

The guide recesses 32 have positioning portions 33 at the most downstream sides thereof in the mounting direction of the process cartridge 8, which position the rotational shaft 20A and have a substantial U shape, when seen from the side. The rotational shaft 20A is positioned by the positioning portions 33, so that the LED array head 141 and the photosensitive drum 20 are kept at a predetermined interval. Also, the rotational shaft 20A is positioned by the positioning portions 33, so that the LED array head 141 and the photosensitive drum 20 take the exposure position at which the LED array head 141 can form an electrostatic latent image on the photosensitive drum 20.

<Support Structure of Exposure Unit>

Figure 2:
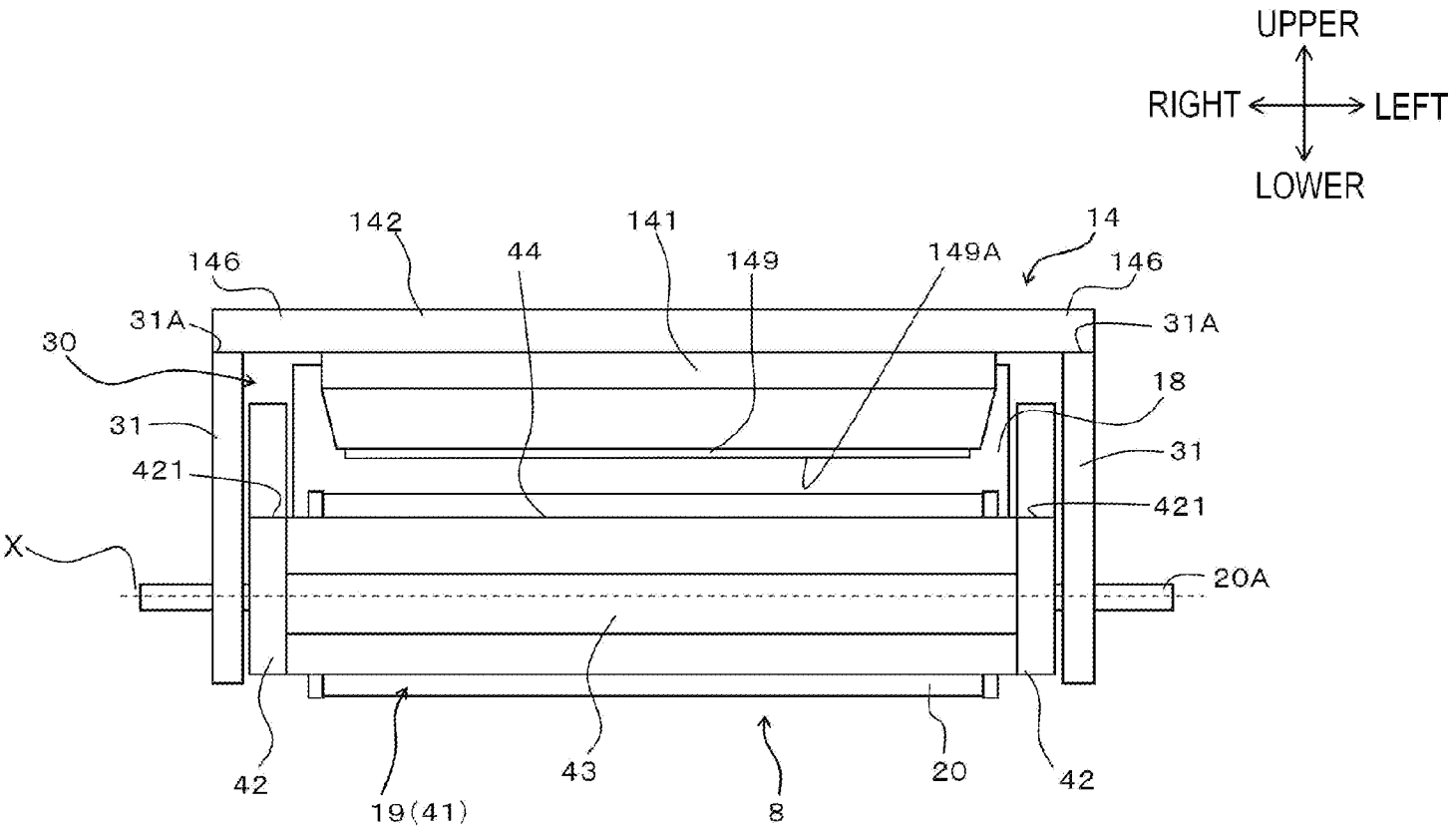
FIG. 2 is a schematic rear view of an exposure unit and a process cartridge.

Hereinafter, a support structure of the exposure unit 14 is described with reference to FIG. 2. FIG. 2 is a rear view of the exposure unit 14 and the process cartridge 8.

As shown in FIG. 2, the head support member 142 is a plate-shaped member having a length in the left-right direction larger than the LED array head 141. The head support member 142 supports an upper surface of the LED array head 141. The head support member 142 has extension parts 146 that are positioned outer than the LED array head in the left-right direction. The extension parts 146 are positioned and fixed at predetermined positions on upper end faces 31A of the sidewalls 31 in the front-rear and upper-lower directions.

<Configuration of Process Cartridge>

In the below, the process cartridge 8 is described with reference to FIGS. 2 and 3. FIG. 3 is a schematic enlarged side sectional view of the process cartridge 8 and the exposure unit 14. In FIG. 3, the process cartridge 8 has been mounted to the mounting part 30. Hereinafter, the developing roller 24, the supply roller 25 and the layer thickness regulation blade 26 are not shown in the sectional view of the process cartridge 8 so as to simplify and to easily understand the drawings.

As shown in FIG. 3, the drum frame 19 has a developing cartridge mounting part 40, to which the developing cartridge 18 is mounted, at a front side thereof and a drum support part 41, at which the photosensitive drum 20 and the scorotron-type charger 21 are supported, at a back side thereof.

As shown in FIGS. 2 and 3, the drum support part 41 has a pair of side plates 42 that is arranged to face each other at an interval in the left-right direction and a charger support part 41A that supports the scorotron-type charger 21. The charger support part 41A is arranged downstream from the drum support part 41 with respect to the mounting direction of the process cartridge 8. The pair of side plates 42 is arranged to sandwich the photosensitive drum 20 and the charger support part 41A from the left-right direction.

As shown in FIGS. 2 and 3, the charger support part 41A has a rear surface part 43 that connects rear end portions of the pair of side plates 42, an upper surface part 44 that extends from an upper end portion of the rear surface part 43 toward the front side and a lower surface part 45 that extends from a lower end of the rear surface part 43 toward the front side. The charger support part 41A is arranged to cover the scorotron-type charger 21 from the upper-lower direction and the rear side by the upper surface part 44, the rear surface part 43 and the lower surface part 45.

As shown in FIGS. 2 and 3, the pair of side plates 42 rotatably supports the rotational shaft 20A by enabling left and right end portions of the rotational shaft 20A to protrude outward beyond the side plates 42.

As shown in FIG. 2, the lower surface part 45 is designed so that a width thereof in the front-rear direction has a size to cover a part of the photosensitive drum 20 and to expose the lower outer periphery of the photosensitive drum 20, when seeing the process cartridge 8 from the below.

The upper surface part 44 is designed so that a width thereof in the front-rear direction has a size to cover a part of the photosensitive drum 20 and to expose the remaining part, when seeing the process cartridge 8 from the above. The upper surface part 44 is provided over the pair of side plates 42 in the left-right direction. As shown in FIG. 3, the upper surface part 44 has a downstream end portion 451 that is an end portion at a downstream side with respect to the mounting direction of the process cartridge 8.

Here, a line that is an example of the first line perpendicularly connecting the rotational axis X of the rotational shaft 20A and a leading end portion 149B of the lens array 149 is indicated with a line L1. The line L1 is perpendicular to the mounting direction of the process cartridge 8. In this illustrative embodiment, since the part of the lens array 149 facing the photosensitive drum 20 is the facing surface 149A, the leading end portion 149B is an intersection of the facing surface 149A and the line L1 when connecting a shaft center 20B and the facing surface 149A at the shortest distance. The exposure unit 14 is positioned on the line L1, when seen from the direction of the rotational axis X. Also, a line passing the leading end portion 149B and being perpendicular to the line L1, i.e., a line parallel with the mounting direction of the process cartridge 8 is indicated with a line L2 that is an example of the second line.

At this time, a part of the process cartridge 8 that is positioned downstream from the line L1 with respect to the mounting direction of the process cartridge 8 is positioned at an opposite side (photosensitive drum 20-side) of the exposure unit 14 with respect to the line L2.

That is, a part of the process cartridge 8 between the downstream end portion 451 and the drum-side facing part 452 is positioned at an opposite side of the LED array head 141 with respect to the line L2. That is, the upper surface part 44 of the charger support part 41A is positioned below the line L2 (at the photosensitive drum 20-side). Here, the line L2 and the mounting direction of the process cartridge 8 are parallel in a cross-section perpendicular to the rotational shaft 20A.

In this illustrative embodiment, the upper surface part 44 is provided continuously to upper end surfaces 421 of the pair of side plates 42 in the left-right direction. Thereby, the upper surface part 44 and the upper end surfaces 421 are designed to have the same height in the upper-lower direction.

By the configuration of the process cartridge 8, the part of the process cartridge 8 positioned between the downstream end portion 451 and the drum-side facing part 452 is always positioned at the photosensitive drum 20-side than the lens array 149 while the process cartridge 8 is being attached and detached to and from the mounting part 30. In other words, the part of the process cartridge 8 positioned between the downstream end portion 451 and the drum-side facing part 452 can pass below the LED array head 141 while the process cartridge 8 being is attached and detached. That is, the charger 21 can pass below the LED array head 141.

<Attaching and Detaching Operations of Process Cartridge>

Figure 4A:
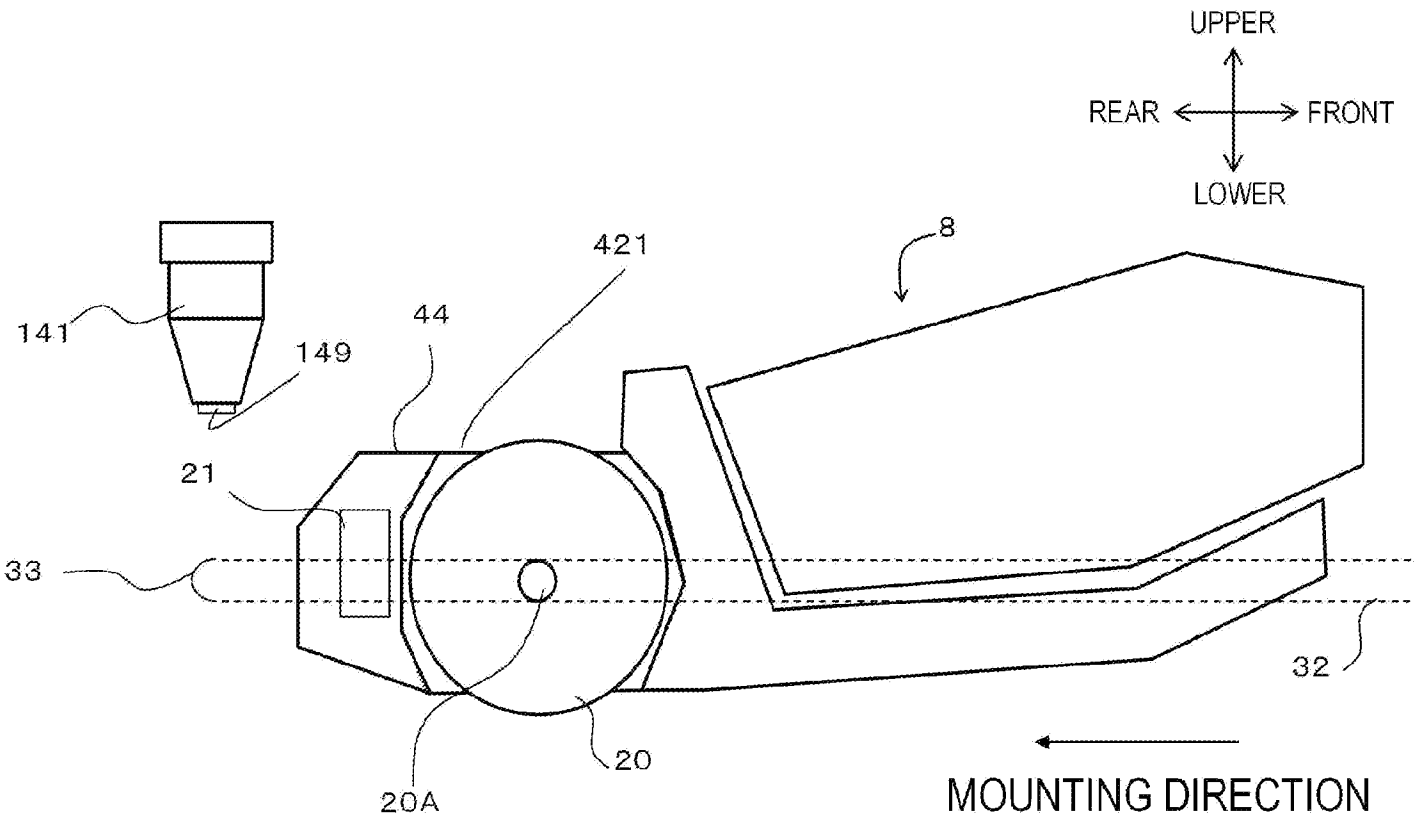
FIG. 4A is a schematic diagram showing a state in which the process cartridge is being mounted to a mounting part.
Figure 4B:
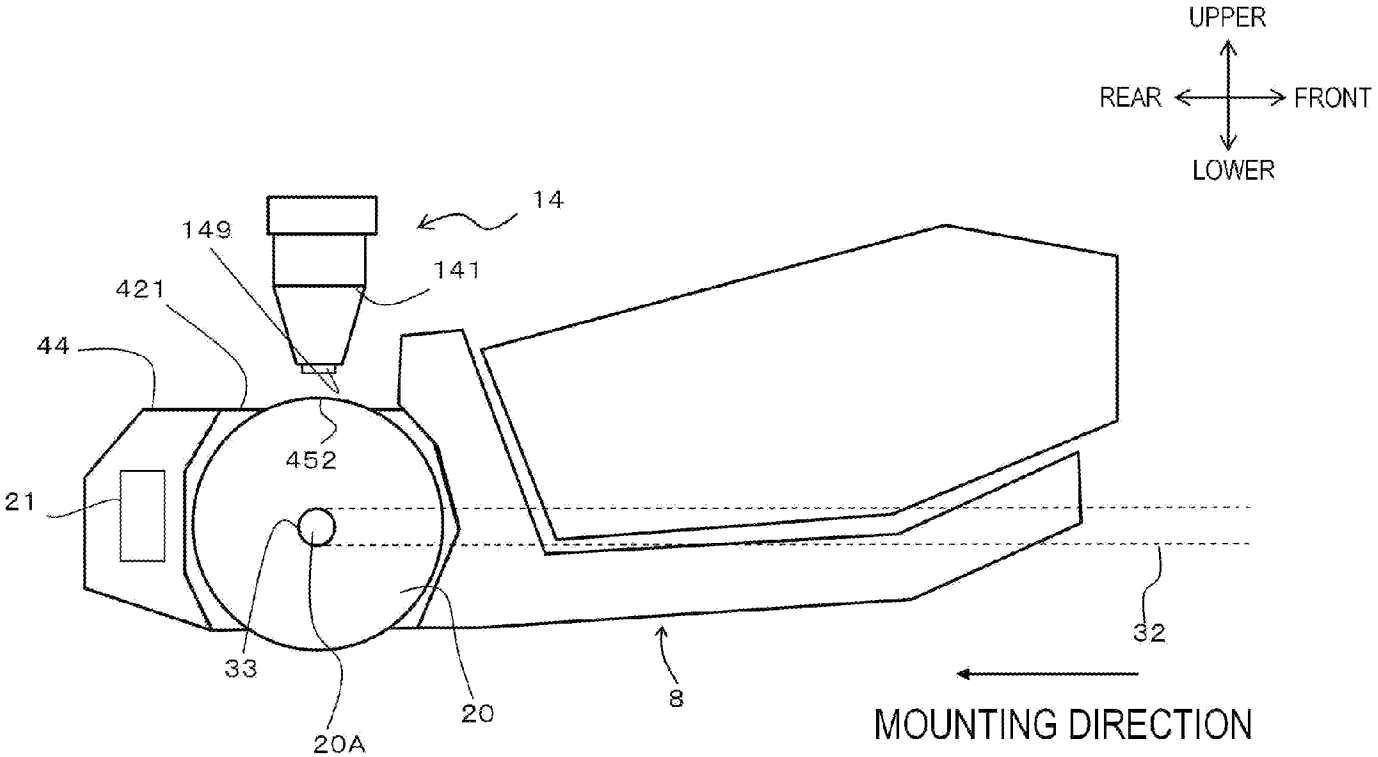
FIG. 4B is a schematic diagram showing a state in which the process cartridge has been mounted to the mounting part.

Hereinafter, the attaching and detaching operations of the process cartridge in this illustrative embodiment are described with reference to FIG. 4. FIG. 4A is a schematic diagram showing a state in which the process cartridge 8 is being mounted to the mounting part 30. FIG. 4B is a schematic diagram showing a state in which the process cartridge 8 has been mounted to the mounting part 30.

As shown in FIG. 4A, the process cartridge 8 is mounted with the cover 7 being opened. The process cartridge 8 is pushed in rearward with the rotational shaft 20A of the photosensitive drum 20 being fitted in the guide recesses 32. Thereby, the process cartridge 8 is guided rearward along the front-rear direction.

Then, the process cartridge 8 is pushed in to a position at which the process cartridge 8 faces the LED array head 141 in the upper-lower direction. At this time, the upper surface part 44 is positioned at the photosensitive drum 20-side than the LED array head 141, when seen from the rotational axis direction of the photosensitive drum 20. Therefore, the upper surface part 44 passes below the LED array head 141 while the process cartridge 8 is being mounted.

Then, as shown in FIG. 4B, the rotational shaft 20A is pushed into the most rearward positions of the guide recesses 32 and is thus fitted in the positioning portions 33, so that the process cartridge 8 is positioned with respect to the exposure unit 14.

Also, even when the process cartridge 8 is detached from the mounting part 30, the rotational shaft 20A is moved from the back side to the front side along the guide recesses 32, so that the upper surface part 44 of the process cartridge 8 passes below the LED array head 141.

According to this illustrative embodiment as described above, the following effects can be realized.

The scorotron-type charger 21 is arranged at the opposite side of the LED array head 141 with respect to the line L1. Thereby, while the process cartridge 8 is attached and detached, the scorotron-type charger 21 does not contact with the LED array head 141. Therefore, in the printer 1 using the LED array head 141, it is possible to attach and detach the process cartridge 8 while simplifying the configuration of the printer 1.

Also, the upper surface part 44 of the charger support part 41A is positioned at the photosensitive drum 20-side in the upper-lower direction with respect to the line L2 passing the leading end portion 149B and being parallel to the attaching/detaching direction of the process cartridge 8, at the state in which the process cartridge 8 has been mounted to the mounting part 30.

By the configuration of the process cartridge 8, the charger 21 of the process cartridge 8 can pass below the lens array 149 of the LED array head 141 when attaching and detaching the process cartridge. Therefore, the process cartridge 8 can be detachably mounted to the printer 1 while simplifying the configuration of the printer 1.

Also, the head support member 142 that supports the LED array head 141 is arranged with respect to the sidewalls 31 configuring the mounting part 30. Thereby, it is possible to position the exposure unit 14 with respect to the photosensitive drum 20 while simplifying the configuration of the printer 1.

Also, as the rotational shaft 20A is positioned by the positioning portions 33, the process cartridge 8 is positioned with respect to the exposure unit 14. Therefore, the photosensitive drum 20 is positioned with respect to the exposure unit 14 more precisely.

Also, the drum frame 19 is provided with the developing cartridge mounting part 40 at the opposite side of the charger support part 41A with the photosensitive drum 20 interposed therebetween. Thereby, it is possible to make the printer 1 small in the upper-lower direction.

First Modified Embodiment

Figure 5:
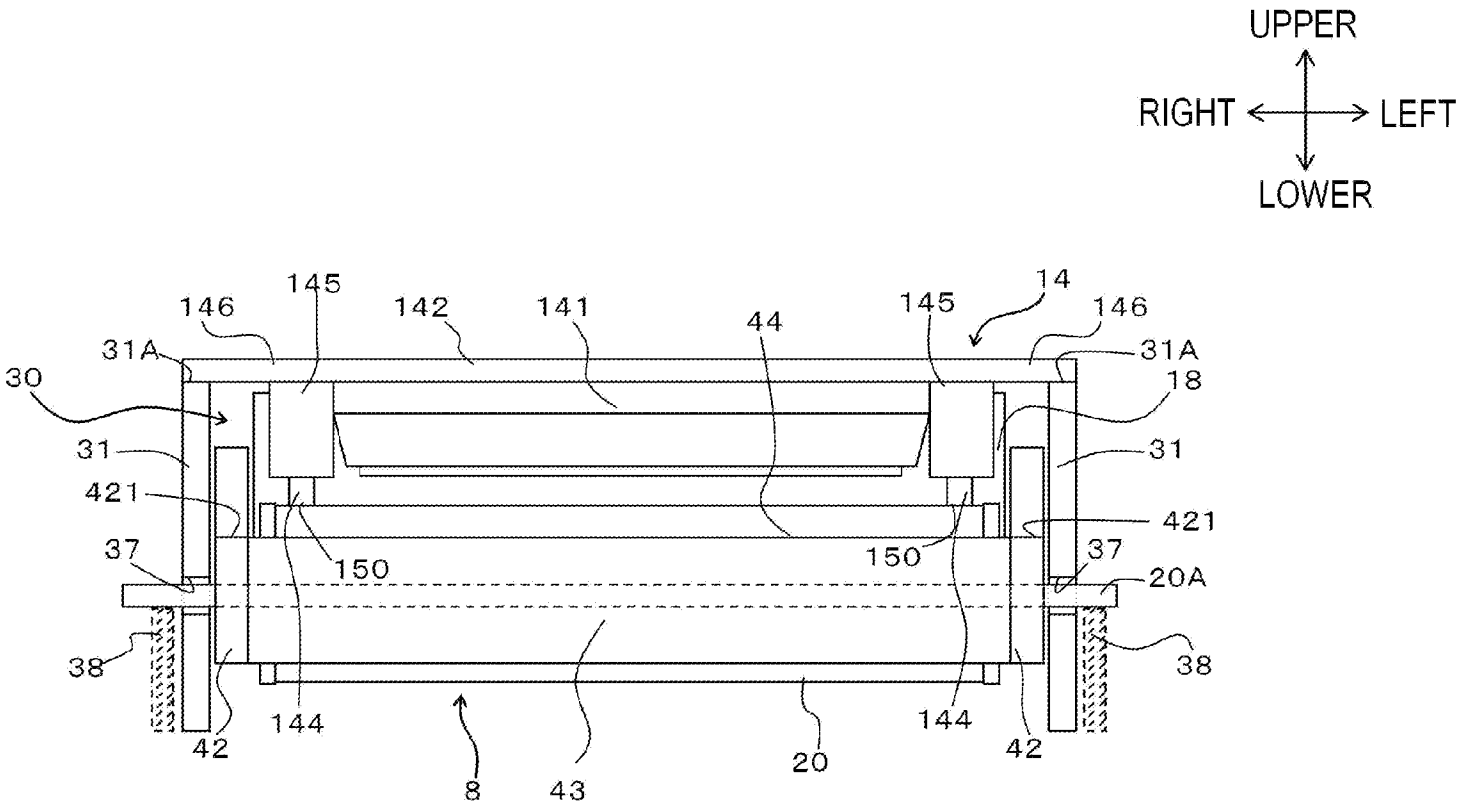
FIG. 5 is a rear view of the process cartridge and the exposure unit according to a first modified embodiment.
Figure 6:
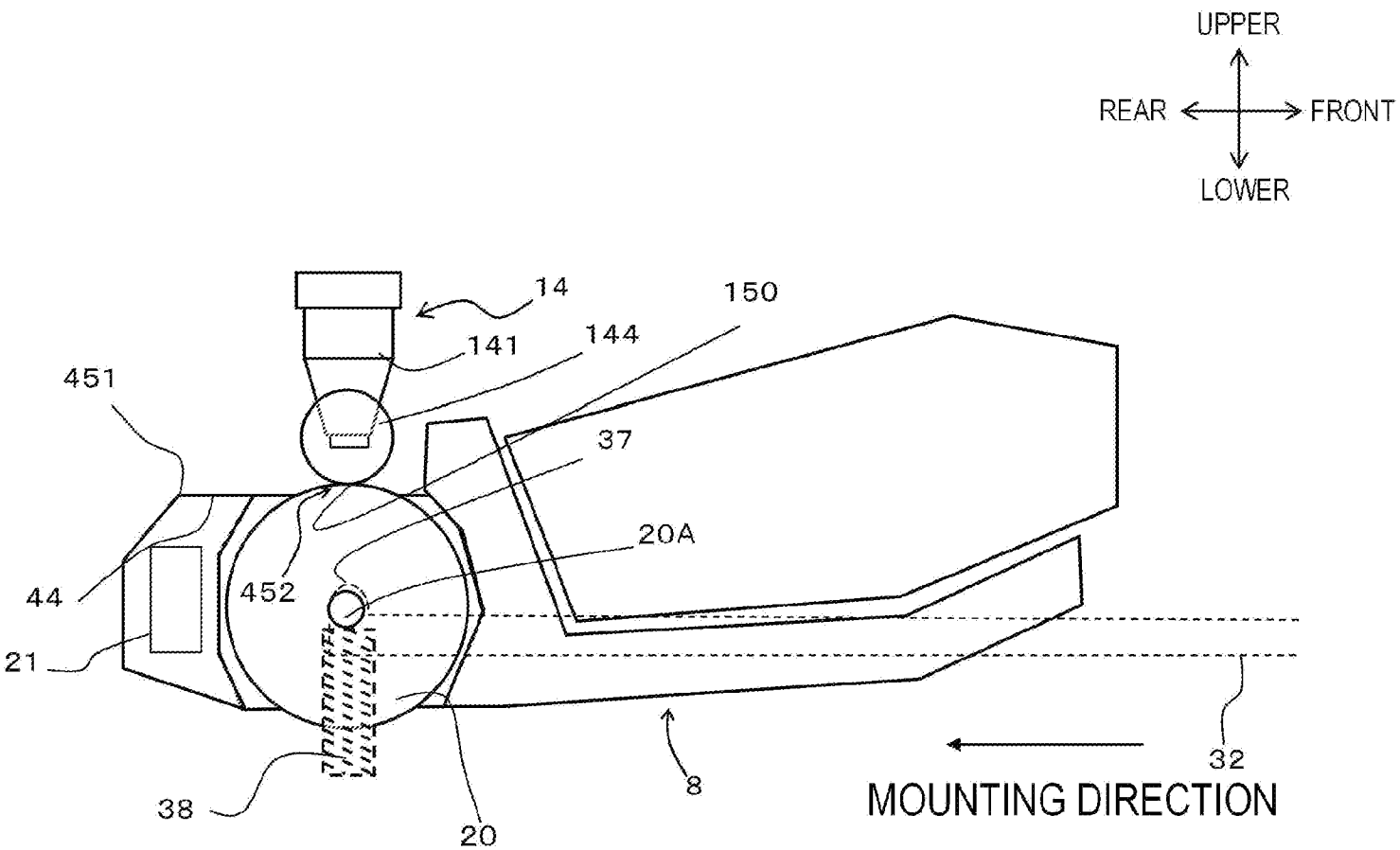
FIG. 6 is a schematic side sectional view of the process cartridge and the exposure unit according to the first modified embodiment.

Hereinafter, a first modified embodiment is described with reference to FIG. 5. FIG. 5 is a rear view of the process cartridge 8 and the exposure unit 14 according to a first modified embodiment. FIG. 6 is a schematic side sectional view of the process cartridge 8 and the exposure unit 14 according to the first modified embodiment. FIGS. 5 and 6 show states in which the process cartridge 8 has been mounted to the mounting part 30. In the below descriptions, the configurations described in the above illustrative embodiment are indicated with the same reference numerals and the descriptions thereof are omitted.

As shown in FIG. 5, the exposure unit 14 has a pair of rollers 144, which is an example of the interval keeping member, and a pair of roller support members 145. The pair of roller support members 145 is rectangular block-type members, when seen from the side, and is arranged adjacent to the LED array head 141 so that the LED array head 141 is interposed between the roller support members in the left-right direction. Upper end portions of the roller support members 145 are fixed to the surfaces of the extension parts 146 facing the photosensitive drum 20. The roller support members 145 rotatably support the rollers 144 at lower end portions thereof with parts of the rollers 144 being accommodated therein.

The head support member 142 is fixed to the sidewalls 31 at the extension parts 146 that are positioned outer than the roller support members 145 in the left-right direction.

The rollers 144 are circular members in a side view. Lower end portions 150, which are an example of the contact part, are brought into contact with the surface of the photosensitive drum 20, so that the rollers 144 keep an interval constant between the photosensitive drum 20 and the LED array head 141.

As shown in FIG. 5, the guide recesses 32 are formed with long holes 37, which rotatably support the rotational shaft 20A in the upper-lower direction, at the most downstream part in the mounting direction (direction from the front side toward the back side) of the process cartridge 8. The body casing 2 is provided therein with spring members 38, which are an example of the first pressing member, at the outer sides of the sidewalls 31 to be adjacent to the long holes 37.

As shown in FIG. 6, the spring members 38 press upward the rotational shaft 20A protruding outward from the sidewalls 31 with the rotational shaft 20A being fitted in the long holes 37. Thereby, the photosensitive drum 20 is upward moved together with process cartridge 8 and is thus brought into contact with the rollers 144. Thereby, the photosensitive drum 20 and the LED array head 141 are kept at a predetermined interval in the upper-lower direction.

Figure 7A:
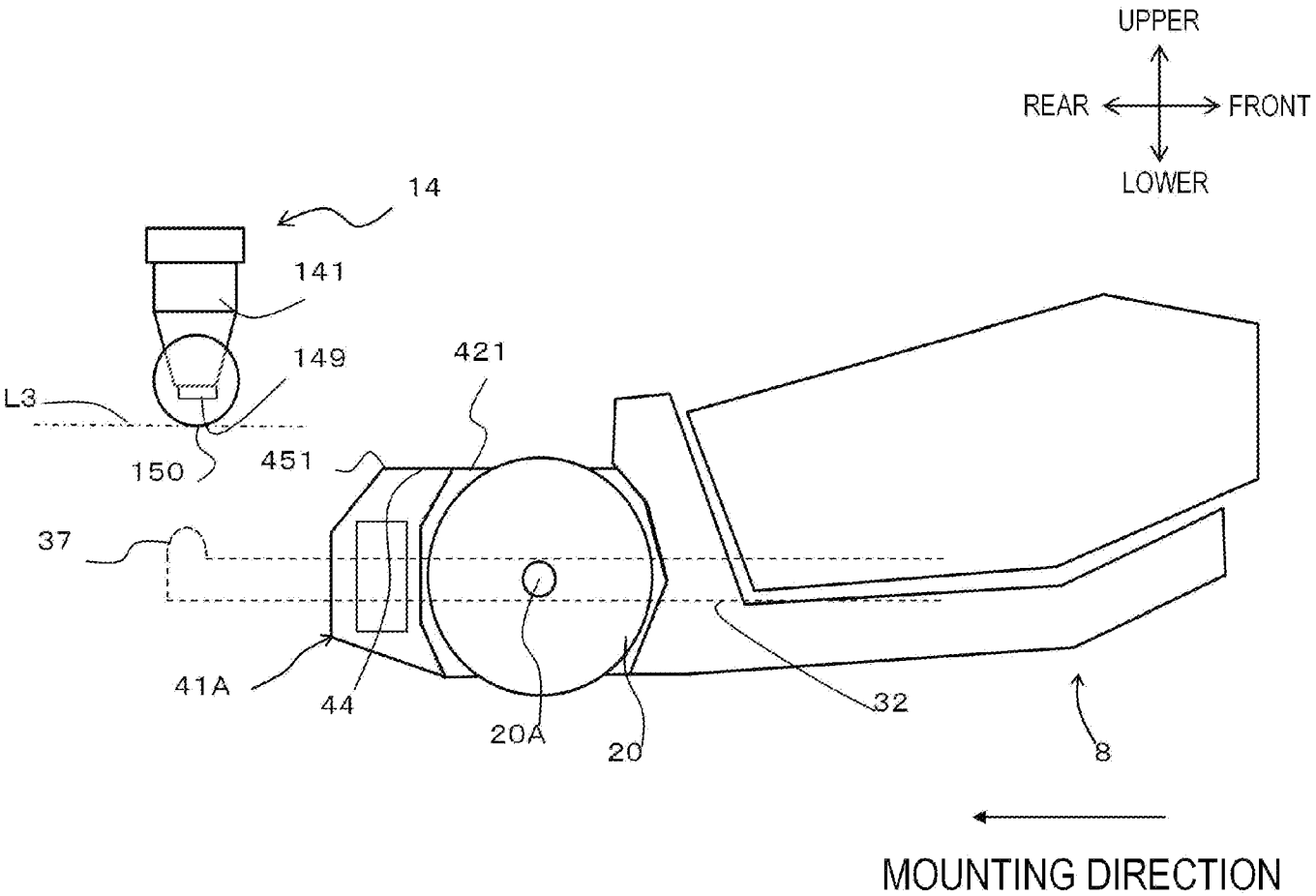
FIG. 7A is a schematic diagram showing a state in which the process cartridge is being mounted to the mounting part in the first modified embodiment.
Figure 7B:
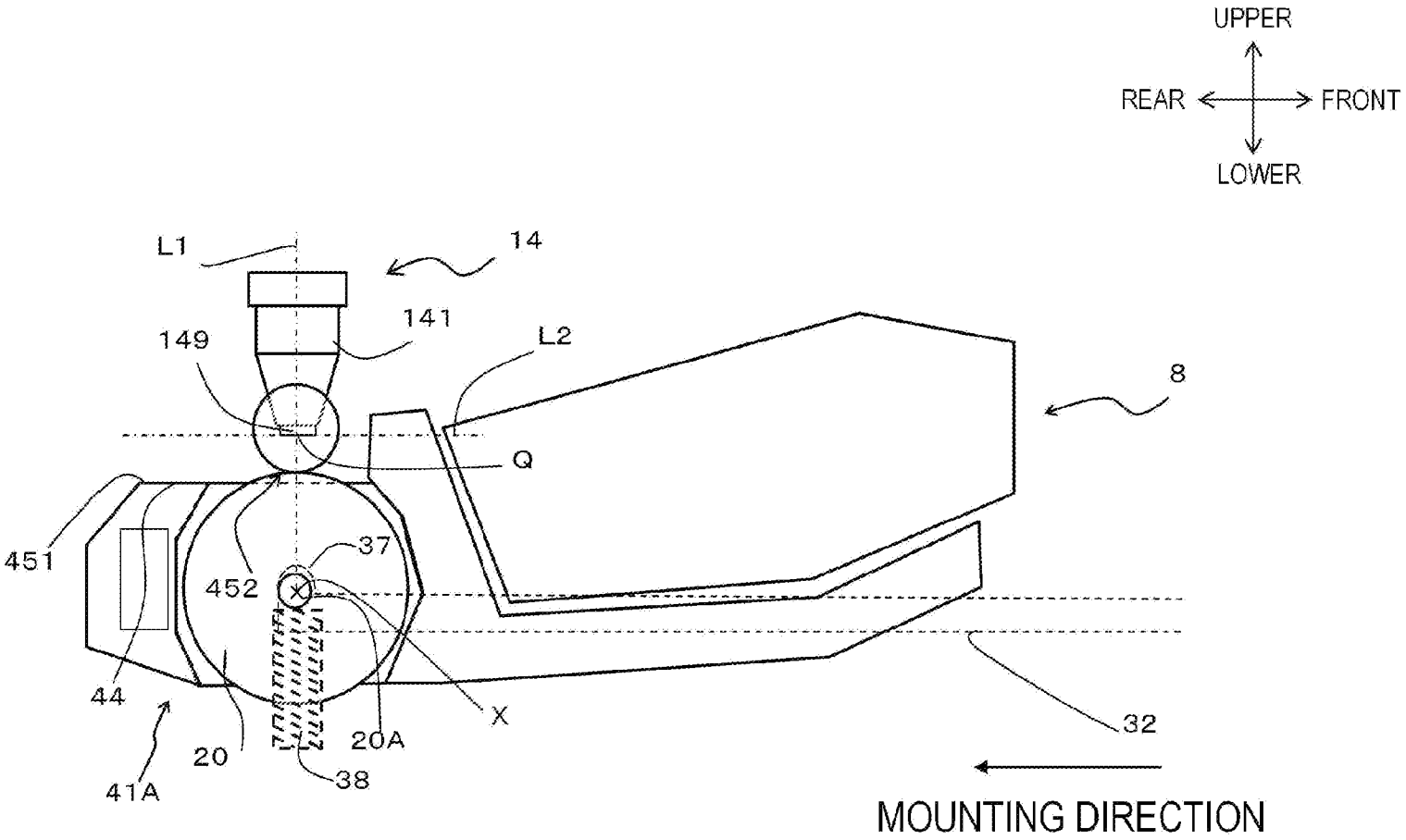
FIG. 7B is a schematic diagram showing a state in which the process cartridge has been mounted to the mounting part in the first modified embodiment.

Hereinafter, the mounting of the process cartridge 8 to the mounting part 30 is described with reference to FIG. 7. FIG. 7A is a schematic diagram showing a state in which the process cartridge 8 is being mounted to the mounting part 30 in the first modified embodiment. FIG. 7B is a schematic diagram showing a state in which the process cartridge 8 has been mounted to the mounting part 30 in the first modified embodiment.

As shown in FIG. 7A, the process cartridge 8 is mounted with the cover 7 being opened. The process cartridge 8 is pushed in rearward with the rotational shaft 20A of the photosensitive drum 20 being fitted in the guide recesses 32. Thereby, the process cartridge 8 is guided rearward along the front-rear direction. The process cartridge 8 is pushed in to a position at which the rotational shaft 20A overlaps with the long holes 37 in the front-rear direction.

After that, the rotational shaft 20A is arranged at the position at which the rotational shaft overlaps with the long holes 37 in the front-rear direction. During the mounting process of the process cartridge 8 until the process cartridge 8 reaches the corresponding position, the upper surface part 44 is positioned at the photosensitive drum 20-side rather than the lower end portions 150 of the rollers 144, when seen from the left-right direction. That is, the charger support part 41A is positioned at the photosensitive drum 20-side than a line L3 passing the lower end portions 150 and being parallel to the mounting direction. Here, the line L3 and the mounting direction of the process cartridge 8 are parallel on the cross-section perpendicular to the rotational shaft 20A.

FIG. 7B shows a state in which the rotational shaft 20A is pressed upward by the spring members 38. For example, the spring member 38 may be configured to press upward the rotational shaft 20A as the cover 7 is closed.

At the state shown in FIG. 7B, the process cartridge 8, which is positioned at the more downstream side than the line L1 with respect to the mounting direction of the process cartridge 8, is positioned at the opposite side (the photosensitive drum 20-side) to the exposure unit 14 with respect to the line L2. That is, the part of the process cartridge 8 between the downstream end portion 451 and the drum-side facing part 452 is positioned at the opposite side of the LED array head 141 with respect to the line L2.

The rotational shaft 20A is pressed by the spring members 38, so that it is moved upward along the long holes 37. The photosensitive drum 20 contacts the lower end portions 150 of the rollers 144. Thereby, the interval between the photosensitive drum 20 and the LED array head 141 in the upper-lower direction is kept at a predetermined interval.

When detaching the process cartridge 8 from the mounting part 30, the pressed state of the rotational shaft 20A is released and the rotational shaft 20A is moved downward. Therefore, the upper surface part 44 is positioned below the line L2. Hence, the drum frame 19 does not contact the LED array head 141 even when detaching the process cartridge 8.

In the first modified embodiment, following effects can be realized.

The part of the process cartridge 8 between the downstream end portion 451 and the drum-side facing part 452 is positioned at the opposite side of the LED array head 141 with respect to the line L2 being parallel to the mounting direction of the process cartridge 8 and being perpendicular to the line L1. Therefore, it is possible to attach and detach the process cartridge 8 to and from the mounting part 30 while the LED array head 141 and the scorotron-type charger 21 do not contact each other.

Also, in the first modified embodiment, the upper surface part 44 is positioned at the photosensitive drum 20-side, with respect to the line L3 passing the lower end portions 150 and extending along the mounting direction of the process cartridge 8. By the configuration of the process cartridge 8, the part of the process cartridge 8 between the downstream end portion 451 and the drum-side facing part 452 is always positioned at the photosensitive drum 20-side rather than the lower end portions 150 while the process cartridge 8 is attached and detached to and from the mounting part 30.

More specifically, the upper surface part 44 is positioned below the line L3. By this configuration, the upper surface part 44 can pass below the lower end portions of the rollers 144 when attaching and detaching the process cartridge 8. Therefore, the process cartridge 8 is attached and detached to and from the printer 1 with a simple configuration of the printer 1.

Also, the rotational shaft 20A is pressed upward by the spring members 38, so that the photosensitive drum 20 is brought into contact with the rollers 144. Accordingly, it is possible to keep the interval between the LED array head 141 with good precision in the left-right direction, without depending on the run-out tolerance of the photosensitive drum 20 with respect to the rotational shaft 20A and the outer diameter tolerance of the photosensitive drum 20.

Also, the rollers 144 are configured to contact the photosensitive drum 20, so that it is possible to reduce the surface damage of the photosensitive drum 20 while keeping the interval between the photosensitive drum 20 and the LED array head 141 with good precision.

Second Modified Embodiment

Figure 8:
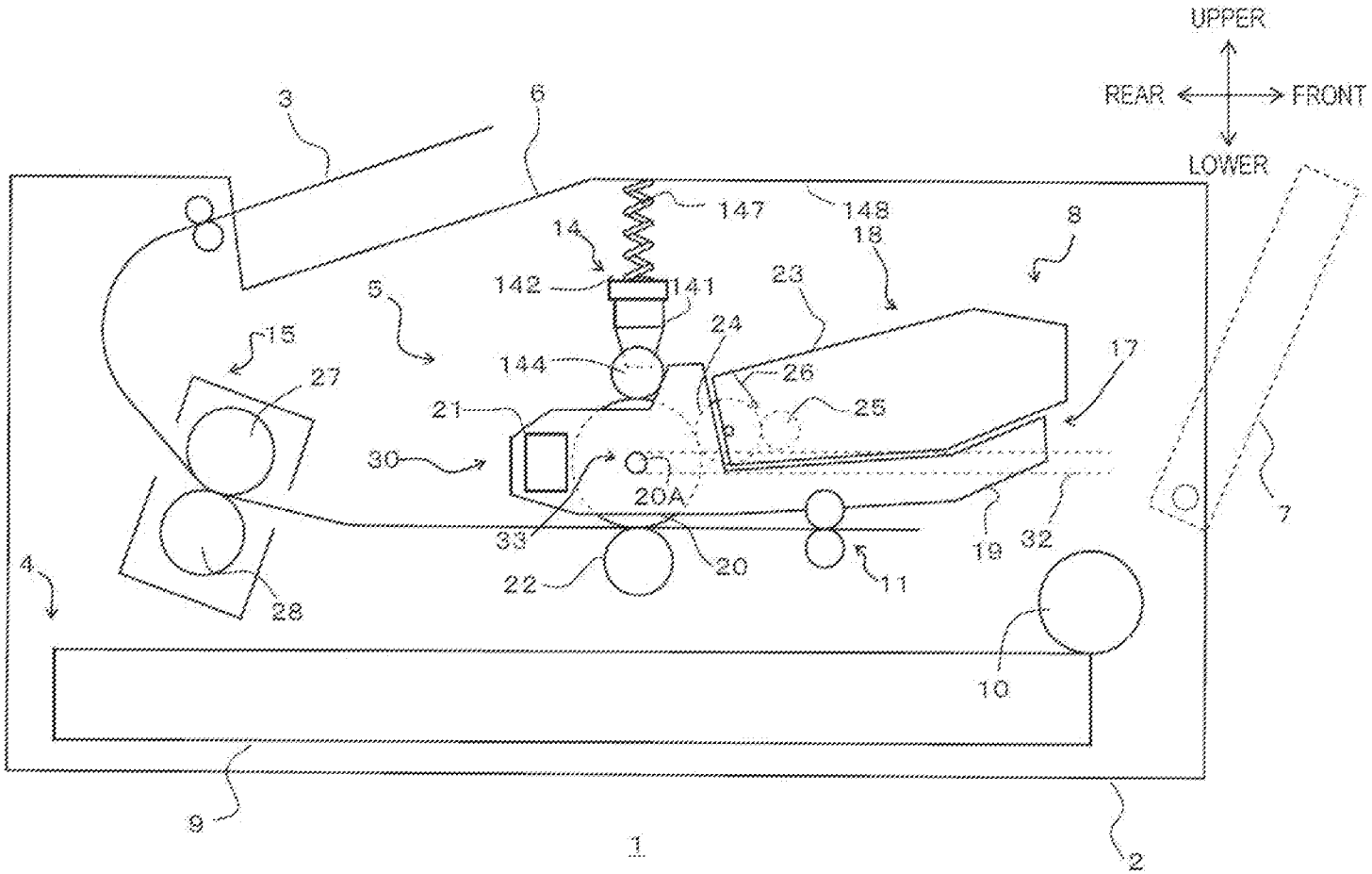
FIG. 8 is a schematic side sectional view of a printer according to a second modified embodiment.
Figure 9A:
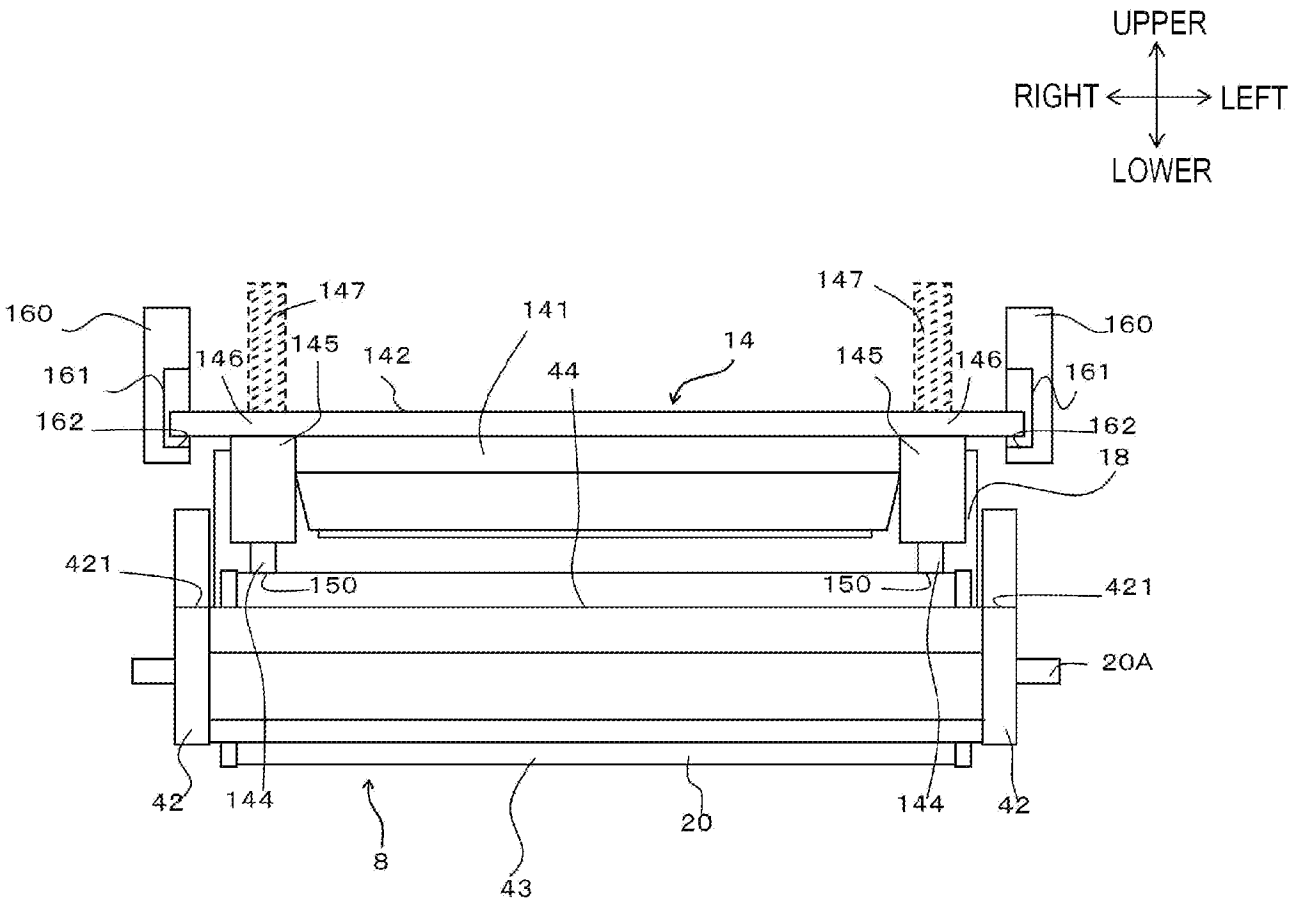
FIG. 9A is a schematic rear view of the process cartridge and the exposure unit according to a second modified embodiment.
Figure 9B:
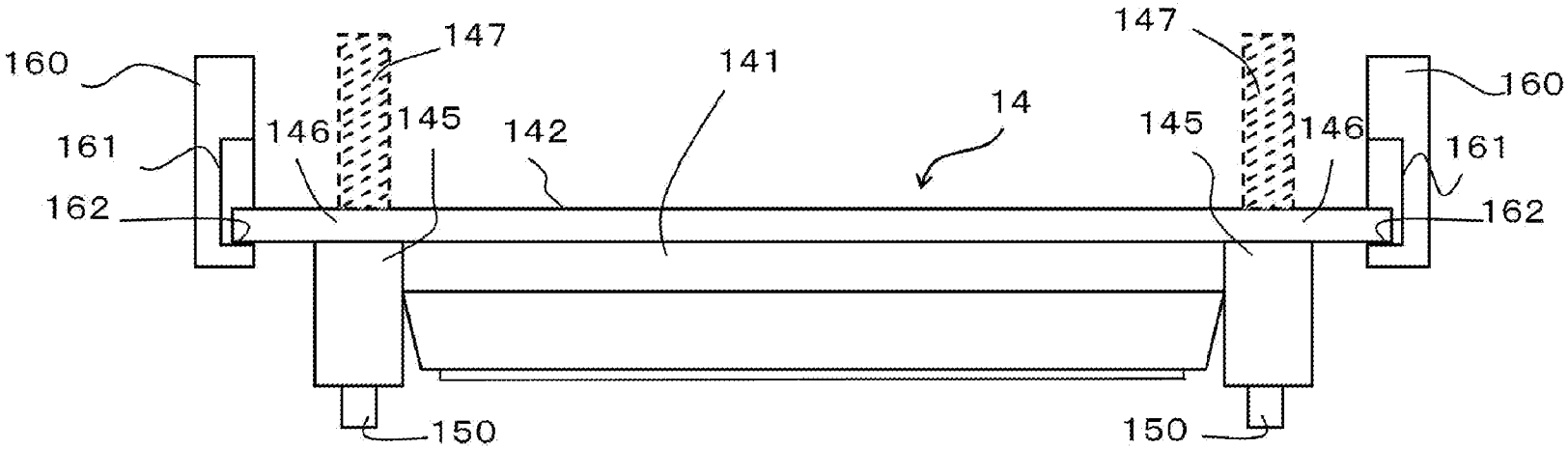
FIG. 9B is a rear view of the exposure unit at a state in which the process cartridge has been removed from the mounting part.

Hereinafter, a second modified embodiment is described with reference to FIGS. 8 and 9. FIG. 8 is a schematic side sectional view of the printer 1 according to a second modified embodiment. FIG. 9A is a schematic rear view of the process cartridge 8 and the exposure unit 14. FIG. 9B is a rear view of the exposure unit 14 at a state in which the process cartridge 8 has been removed from the mounting part 30.

As shown in FIG. 8, upper end portions of support springs 147 that are an example of the second pressing member are fixed to an upper wall 148 of the body casing 2.

As shown in FIGS. 8 and 9, the head support member 142 that is an example of the support member of the exposure unit 14 supports the LED array head 141 so that the LED array head can move vertically with respect to the body casing 2. A pair of the support springs 147 is arranged above the head support member 142 in the body casing 2. Lower end portions of the support springs 147 are fixed on the upper surfaces of the extension parts 146. The head support member 142 is supported by the support springs 147, so that it can be vertically moved elastically together with the LED array head 141.

Also, in the second modified embodiment, as shown in FIG. 9, restraint members 160 that restrain the vertical moving of the head support member 142 are provided adjacent to the outer sides of both end portions of the head support member 142 in the left-right direction, in the body casing 2.

The restraint member 160 is a rectangular block-type member, when seen from the side. A surface of the restraint member 160 facing the exposure unit 14 is formed with a recess portion 161 that is recessed toward the outer side in the left-right direction. The recess portion 161 is formed with a restraint surface 162 that is a surface substantially parallel with a surface on which the LED array head is supported by the head support member 142.

Both end portions of the head support member 142 in the left-right direction are positioned in the recess portions 161. That is, both end portions of the head support member 142 in the left-right direction are positioned at positions overlapping with the restraint members 160, when seen from the upper-lower direction. The head support member 142 can be moved vertically in the recess portions 161.

As shown in FIG. 9B, at a state in which the process cartridge 8 is removed and the restraint surfaces 162 and the head support member 142 contact, the support springs 147 are compressed in the upper-lower direction and press downward the head support member 142. As shown in FIG. 9A, at the state in which the process cartridge 8 is mounted, the rollers 144 and the photosensitive drum 20 contact each other, so that the head support member 142 is moved upward against the pressing force of the support springs 147. The restraint surfaces 162 and the head support member 142 are separated.

As shown in FIG. 9, the exposure unit 14 has the pair of rollers 144 and the pair of roller support members 145. Since the rollers 144 and the roller support members 145 have the same configurations as those described in the first modified embodiment, the descriptions thereof are omitted.

Figure 10A:
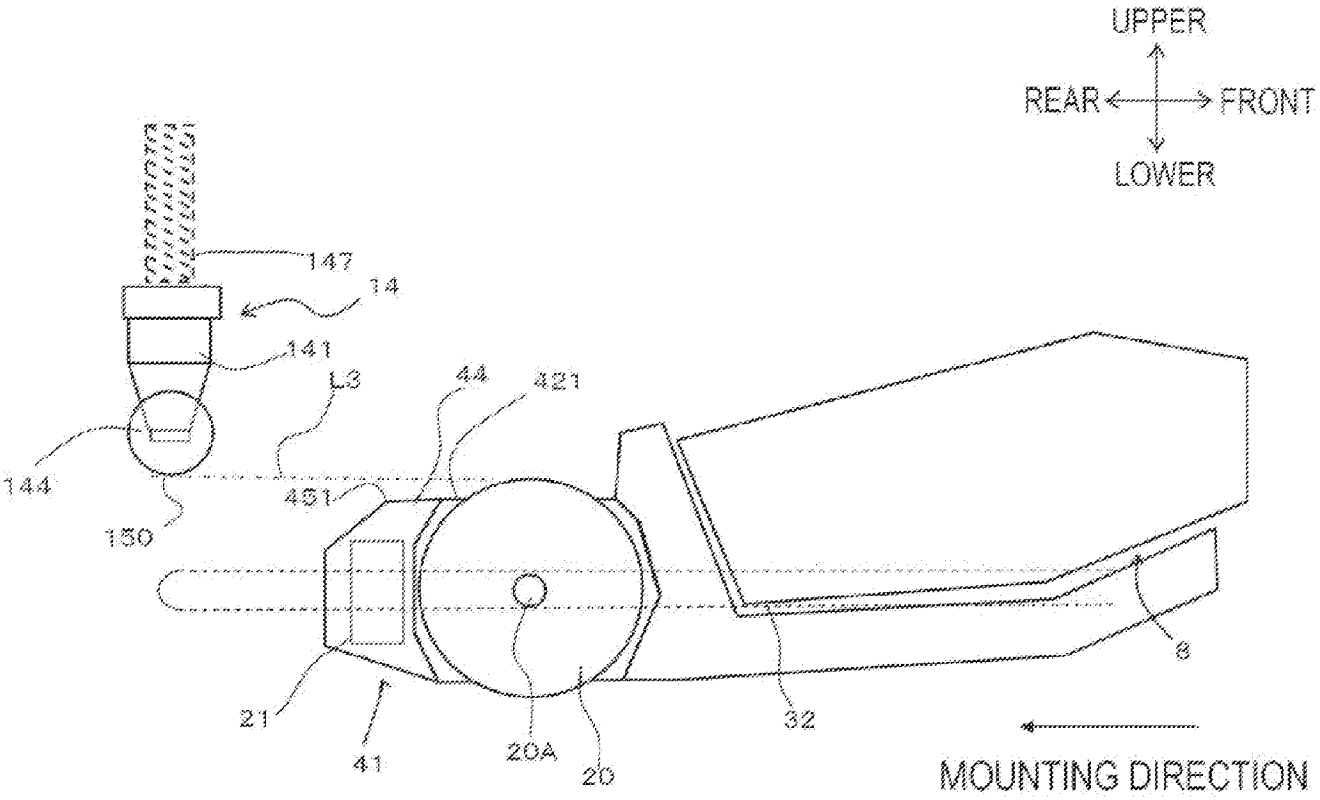
FIG. 10A is a schematic diagram showing a state in which the process cartridge is being mounted to a body casing in the second modified embodiment.
Figure 10B:
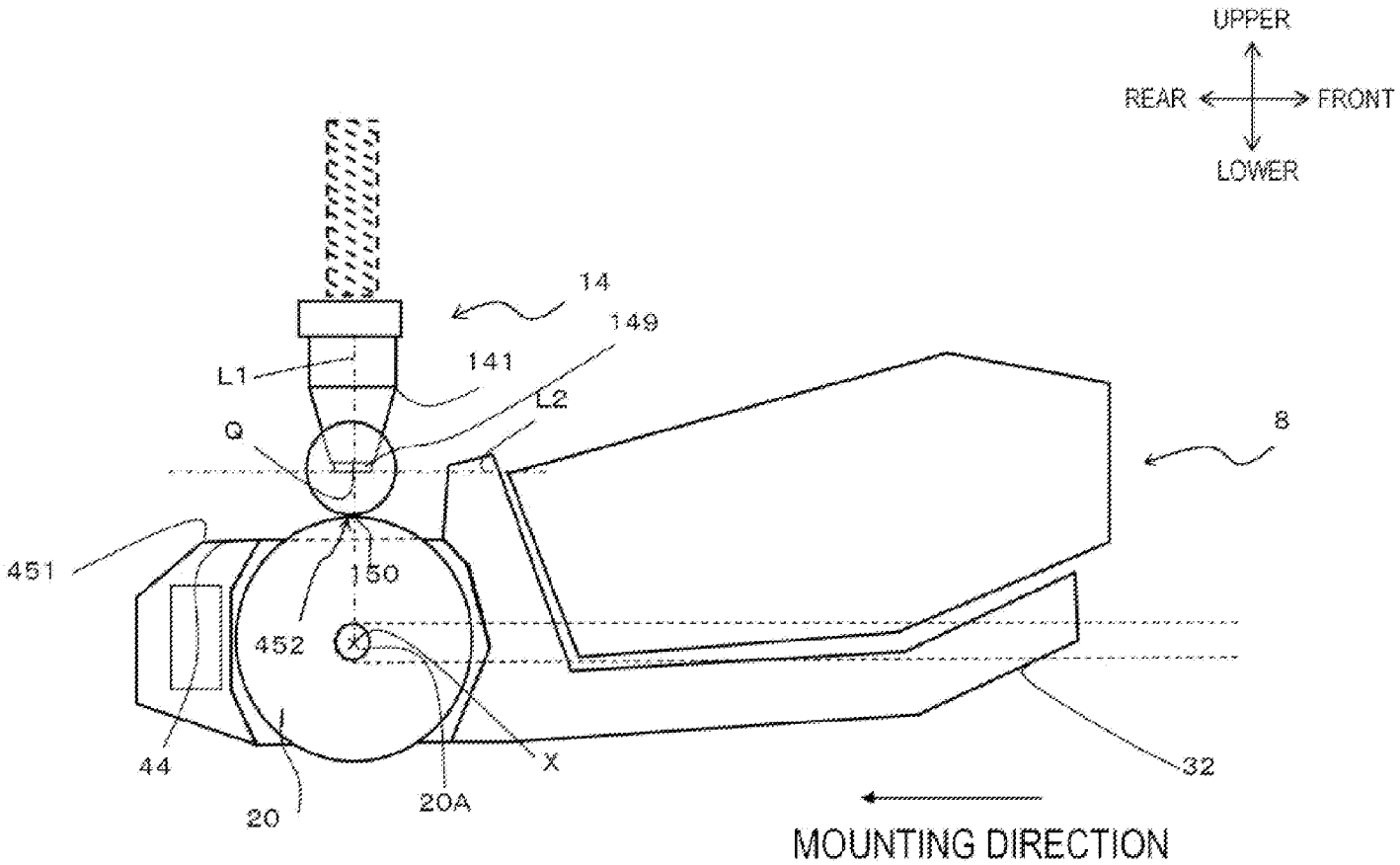
FIG. 10B is a schematic diagram showing a state in which the process cartridge has been mounted to the body casing in the second modified embodiment.
Figure 11:
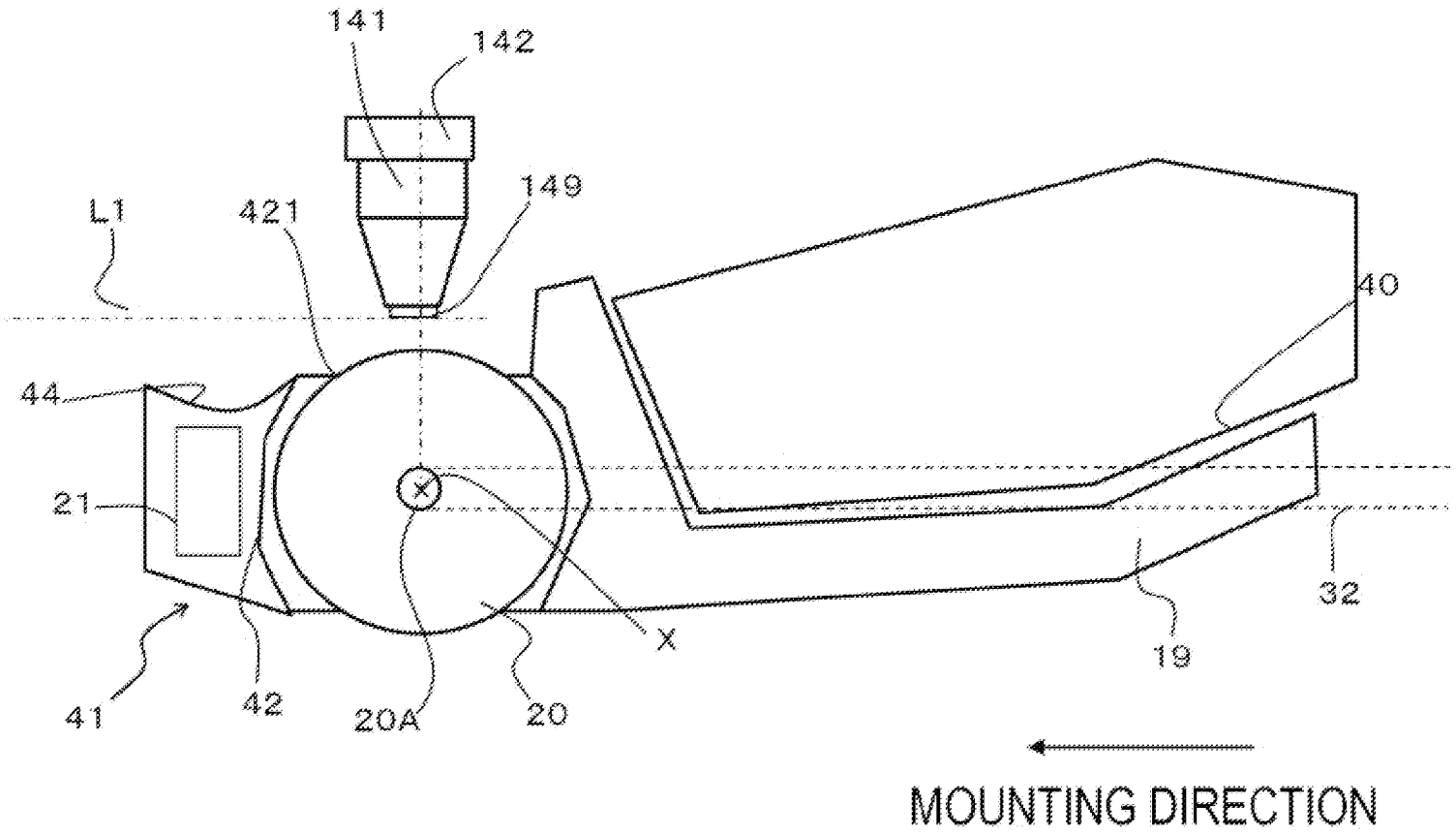
FIG. 11 is a view showing another illustrative embodiment with respect to a notch part.

Hereinafter, the attaching and detaching operations of the process cartridge 8 to and from the mounting part 30 according to the second modified embodiment are described with reference to FIG. 10. FIG. 10A is a schematic diagram showing a state in which the process cartridge 8 is being mounted to the body casing 2 in the second modified embodiment. FIG. 10B is a schematic diagram showing a state in which the process cartridge 8 has been mounted to the body casing 2 in the second modified embodiment.

As shown in FIG. 10A, the process cartridge 8 is pushed in rearward with the rotational shaft 20A of the photosensitive drum 20 being fitted in the guide recesses 32. Thereby, the process cartridge 8 is guided rearward along the front-rear direction.

As shown in FIG. 10A, the part of the process cartridge 8 between the downstream end portion 451 and the drum-side facing part 452 is positioned at the opposite side of the LED array head 141 with respect to the line L3 passing to the lower end portions 150 and following the mounting direction of the process cartridge 8.

Here, the line L3 and the mounting direction of the process cartridge 8 are parallel on the section perpendicular to the rotational shaft 20A. Also, in the second modified embodiment, the drum-side facing part 452 is a part at which the lower end portions above the photosensitive drum 20 and the photosensitive drum 20 contact each other at the state in which the process cartridge 8 is mounted to the mounting part 30.

Accordingly, while the process cartridge 8 is being mounted, the upper surface part 44 passes below the lower end portions 150. Also, the lower end portions 150 are positioned at the more downstream sides than the drum-side facing part 452 of the photosensitive drum 20, when seen from the left-right direction. The photosensitive drum 20 and the rollers 144 are arranged in the above positional relation, so that they are contacted to each other as the process cartridge 8 is mounted.

When the process cartridge 8 is pushed in more rearward, the rollers 144 are brought contact with the photosensitive drum 20. Also, as the process cartridge 8 is pushed in rearward, the exposure unit 14 is moved upward against the pressing force of the support springs 147.

As shown in FIG. 10B, as the rotational shaft 20A is pushed into the deepest positions of the guide recesses 32, the LED array head 141 is positioned while keeping a predetermined interval with the photosensitive drum 20. At a state shown in FIG. 10B, the part of the process cartridge 8 between the downstream end portion 451 and the drum-side facing part 452 is positioned at the opposite side of the LED array head 141 with respect to the line L2 following the mounting direction of the process cartridge 8 and perpendicular to the line L1.

According to the second modified embodiment, following effects can be realized.

The part of the process cartridge 8 between the downstream end portion 451 and the drum-side facing part 452 is positioned at the opposite side of the LED array head 141 with respect to the line L2 following the mounting direction of the process cartridge 8 and perpendicular to the line L1. Accordingly, the process cartridge 8 can be attached and detached to and from the mounting part 30 while the LED array head 141 and the scorotron-type charger 21 do not contact each other.

The part of the process cartridge 8 between the downstream end portion 451 and the drum-side facing part 452 is positioned at the opposite side of the LED array head 141 with respect to the line L3 passing to the lower end portions 150 and following the mounting direction of the process cartridge 8. Thereby, the upper surface part 44 is positioned below the line L3.

Thereby, the process cartridge 8 is attached and detached to and from the mounting part 30 without contacting the charger support part 41A. Also, the exposure unit 14 is urged toward the photosensitive drum 20 by the support springs 147. Thereby, it is possible to keep the interval between the photosensitive drum 20 and the LED array head 141 with good precision while simplifying the configuration of the printer 1. Also, since the rollers 144 and the process cartridge 8 do not contact each other, it is possible to reduce the wear of the rollers 144.

Other Illustrative Embodiments

In the above-described illustrative embodiment, the LED array head 141 is fixed to the sidewalls 31 via the head support member 142. However, the LED array head may be directly fixed to the sidewalls 31.

In the above-described illustrative embodiment, the upper surface part 44 is positioned below an imaginary line extending to the upper end surfaces 421 of the side plates 42 in the left-right direction. However, a length of the upper surface part 44 corresponding to at least LED array head 141 in the left-right direction or a length of the interval between the rollers 144 in the left-right direction may be positioned below the imaginary line. In other words, while the process cartridge 8 is attached and detached, at least the part of the upper surface part 44 facing the LED array head 141 in the upper-lower direction may be positioned below the line L2.

In the above-described illustrative embodiment, the LED array head 141 has been adopted as the exposure member. However, regarding the light source of the exposure member, the invention is not limited to the LED. For example, an EL (Electro Luminescence) device, a fluorescent body and the like may be used.

In the above-described illustrative embodiment, the black-and-white printer has been adopted as the printer 1. However, a color printer may be also adopted.

In the above-described illustrative embodiment, the upper surface part 44 is a line type following the guide recess 32. However, even though the guide recess 32 is linear, the upper surface part 44 is not necessarily linear. For example, as shown in FIG. 10, the upper surface part 44 may be curved downward, when seen from the left-right direction.

In the above-described illustrative embodiment, the exposure unit 14 is arranged above the process cartridge 8. However, the process cartridge may be sandwiched between the exposure unit 14 positioned below the process cartridge 8 and the transfer rollers 22 positioned above the process cartridge 8.

The invention can be implemented in illustrative, non-limiting aspects as follows:

(1) In a first aspect, there is provided an image forming apparatus including: a main body; a process cartridge being detachably mounted to the main body along a direction perpendicular to a rotational axis direction which is a direction of a rotation axis of a photosensitive member, the process cartridge including, the photosensitive member, and a charger facing a surface of the photosensitive member and charging the surface of the photosensitive member; and an exposure device that exposes the photosensitive member at a state in which the process cartridge is mounted, the exposure device including, a plurality of light emitting devices arranged along the rotational axis direction, and a facing part, wherein the charger is arranged to be adjacent to the photosensitive member at a downstream side with respect to a mounting direction of the process cartridge, wherein the exposure device is positioned on a first line, which intersects with the rotation axis and is perpendicular to the mounting direction when seen from the rotational axis direction, at a state in which the process cartridge is mounted, wherein the facing part is a part of the exposure device that is positioned closest to the photosensitive member and faces the surface of the photosensitive member when seen from the rotational axis direction, at a state in which the process cartridge is mounted, and wherein the charger is positioned at an opposite side of the exposure device with respect to a second line which is parallel with the mounting direction and passes the facing part when seen from the rotational axis direction.

According to the first aspect, the process cartridge includes the photosensitive member and the charger that charges a surface of the photosensitive member. The exposure device that exposes the photosensitive member is positioned on the first line, which intersects with the rotational axis and is perpendicular to the mounting direction when seen from the rotational axis direction, at a state in which the process cartridge is mounted. The charger is positioned at an opposite side of the exposure device with respect to the second line parallel with the mounting direction of the process cartridge and passes the facing part. Thereby, the exposure device does not contact to the charger while the process cartridge is being attached and detached. Accordingly, in the image forming apparatus using an exposure device, it is possible to attach and detach the process cartridge with a simple configuration of the image forming apparatus.

(2) In a second aspect, there is provided the image forming apparatus according to the first aspect, wherein the exposure device includes a lens array that generates an image in accordance with lights emitted from the light emitting elements, and wherein the facing part is a leading end portion of the lens array that faces the photosensitive member, at a state in which the process cartridge is mounted.

According to the second aspect, it is possible to prevent the contact of the lens array and the charger when attaching and detaching the process cartridge. Therefore, it is possible to reduce a damage of the lens array caused due to the contact with the process cartridge.

(3) In a third aspect, there is provided the image forming apparatus according to the first aspect, wherein the main body has a mounting part to which the process cartridge is detachably mounted, wherein the mounting part has a pair of sidewalls that is arranged to face each other in the rotational axis direction, and wherein the exposure device is arranged with respect to the sidewalls.

According to the third aspect, the mounting part to which the process cartridge is detachably attached is provided with the pair of sidewalls. The exposure device is arranged with respect to the sidewalls. Thereby, it is possible to attach and detach the process cartridge while simplifying the configuration of the apparatus main body and to position the exposure device with respect to the photosensitive member.

(4) In a fourth aspect, there is provided the image forming apparatus according to the third aspect, wherein the pair of sidewalls is formed with a guide part that guides the process cartridge to a position at which the photosensitive member and the facing part face each other along the mounting direction.

According to the fourth aspect, the sidewalls are formed with the guide part that guides the process cartridge to a position at which the photosensitive member and the facing part face each other in a direction following the mounting direction of the process cartridge. Thereby, it is possible to easily mount the process cartridge toward the position at which the photosensitive member and the facing part face each other.

(5) In a fifth aspect, there is provided the image forming apparatus according to the fourth aspect, wherein the guide part has a positioning portion that positions the process cartridge at the position at which the photosensitive member and the facing part face each other.

According to the fifth aspect, the process cartridge is positioned with respect to the exposure device at the position at which the photosensitive member and the facing part face each other. Therefore, the photosensitive member is positioned with respect to the exposure device more precisely.

(6) In a sixth aspect, there is provided the image forming apparatus according to the first aspect, wherein the exposure device includes: an exposure head that includes the light emitting devices, and interval keeping members that are arranged at both sides of the exposure head in the rotational axis direction and contact the process cartridge, thereby keeping an interval constant between the exposure head and the photosensitive member, wherein the main body includes a first pressing member that presses the process cartridge toward the interval keeping members at a position at which the photosensitive member and the exposure head face each other, and wherein the interval keeping members contact with the process cartridge by the process cartridge being pressed by the first pressing member.

According to the sixth aspect, the process cartridge is pressed toward the interval keeping members by the pressing member at the position at which the photosensitive member and the facing part face each other. Thereby, it is possible to keep the interval constant between the photosensitive member and the exposure head without depending on a run-out tolerance of the photosensitive member with respect to the rotational axis.

(7) In a seventh aspect, there is provided the image forming apparatus according to the first aspect, wherein the main body includes: a support member that movably supports the exposure device in a direction intersecting with the mounting direction of the process cartridge, and a second pressing member that presses the support member toward the photosensitive member, and wherein the exposure device includes: an exposure head that includes the light emitting devices, and interval keeping members that are arranged at both sides of the exposure head in the rotational axis direction and contact the process cartridge, thereby keeping an interval constant between the exposure head and the photosensitive member.

According to the seventh aspect, the support member is pressed toward the photosensitive member by the second pressing member. Thereby, it is possible to keep the interval between the photosensitive member and the exposure head with good precision while simplifying the configuration of the apparatus main body.

(8) In an eighth aspect, there is provided the image forming apparatus according to the sixth aspect, wherein the interval keeping members contact the photosensitive member.

According to the eighth aspect, it is possible to keep the interval between the photosensitive member and the exposure device with more precision as the interval keeping members contact the photosensitive member.

(9) In a ninth aspect, there is provided the image forming apparatus according to the sixth aspect, wherein the interval keeping members are rollers that are configured to rotate by contact with the photosensitive member.

According to the ninth aspect, the rollers that rotate are used as the interval keeping members. Thereby, it is possible to reduce the surface damage of the photosensitive member by the contact of contact parts of the roller members and the photosensitive member.

(10) In a tenth aspect, there is provided the image forming apparatus according to the first aspect, wherein the process cartridge includes a developer accommodation part, which accommodates therein developers to be supplied to the surface of the photosensitive member, at an opposite side of the charger with the photosensitive member interposed therebetween.

According to the tenth aspect, the process cartridge includes the developer accommodation part, which accommodates therein developers to be supplied to the surface of the photosensitive member, at an opposite side of the charger with the photosensitive member interposed therebetween. Thereby, it is possible to make the image forming apparatus small in a direction intersecting with the mounting direction of the process cartridge.

(11) In an eleventh aspect, there is provided the image forming apparatus according to the first aspect, wherein a part of the process cartridge, which is positioned downstream to the first line in the mounting direction, is positioned at the opposite side of the exposure device with respect to the second line.

(12) In a twelfth aspect, there is provided the image forming apparatus according to the first aspect, wherein a substantially center of the exposure device, in the mounting direction, is positioned on the first line, at a state in which the process cartridge is mounted.

The invention claimed is:

1. An image forming apparatus comprising:

a main body;

a process cartridge being detachably mounted to the main body along a mounting direction perpendicular to a rotational axis direction which is a direction of a rotation axis of a photosensitive member, the process cartridge including, the photosensitive member, and a charger facing a surface of the photosensitive member and configured to charge the surface of the photosensitive member; and an exposure device configured to expose the photosensitive member in a state wherein which the process cartridge is mounted to the main body, the exposure device including, an exposure head including a plurality of light emitting devices arranged along the rotational axis direction, and a facing part that is a part of the exposure head that is positioned closest to the photosensitive member and faces the surface of the photosensitive member when seen from the rotational axis direction at the state in which the process cartridge is mounted, and interval keeping members that are arranged at both sides of the exposure head in the rotational axis direction and contact the photosensitive member, thereby keeping an interval constant between the exposure head and the photosensitive member, wherein the charger is arranged to be adjacent to the photosensitive member at a downstream side with respect to the mounting direction of the process cartridge, wherein the exposure device is positioned on a first line, which intersects with the rotation axis and is perpendicular to the mounting direction when seen from the rotational axis direction, in the state wherein the process cartridge is mounted to the main body, wherein the charger is positioned at an opposite side of the exposure device with respect to a second line which is parallel with the mounting direction and passes the facing part when seen from the rotational axis direction, wherein the main body includes a pressing member that presses the process cartridge toward the interval keeping members at a position at which the photosensitive member and the exposure head face each other, wherein the interval keeping members contact with the process cartridge by the process cartridge being pressed by the pressing member, wherein the exposure device is positioned and fixed to the main body in an upper-lower direction;

wherein the main body includes a first guide part extending in the mounting direction and a second guide part extending in a direction perpendicular to the mounting direction, wherein the first guide part is configured to guide the process cartridge along the mounting direction, wherein the second guide part extends in the direction perpendicular to the mounting direction from an end portion of the first guide part at the downstream side in the mounting direction, wherein the pressing member presses the process cartridge in the direction perpendicular to the mounting direction such that the process cartridge is guided through the second guide part, wherein each interval keeping member includes a contact part that contacts the photosensitive member, in the state where the process cartridge is mounted to the main body, wherein the process cartridge includes a frame that supports the photosensitive member, wherein the frame includes a charger support part that supports the charger, wherein the charger support part has an upper surface, which is a surface at the opposite side of the exposure device and is substantially parallel to the second line, wherein the upper surface is positioned lower than the contact part of the interval keeping member, in the state where the process cartridge is mounted to the main body, and wherein the mounting direction is parallel to the second line.

2. The image forming apparatus according to claim 1, wherein the exposure device includes a lens array configured to generate an image in accordance with lights emitted from the light emitting elements, and wherein the facing part is a leading end portion of the lens array that faces the photosensitive member, at the state in which the process cartridge is mounted.

3. The image forming apparatus according to claim 1, wherein the main body has a mounting part to which the process cartridge is detachably mounted, wherein the mounting part has a pair of sidewalls that is arranged to face each other in the rotational axis direction, and wherein the exposure device is arranged with respect to the sidewalls.

4. The image forming apparatus according to claim 3, wherein the first guide part and the second guide part are formed to the pair of sidewalls and are configured to guide the process cartridge to a position at which the photosensitive member and the facing part face each other.

5. The image forming apparatus according to claim 1, wherein the interval keeping members are rollers that are configured to rotate by contact with the photosensitive member.

6. The image forming apparatus according to claim 1, wherein the process cartridge includes a developer accommodation part, which accommodates therein developers to be supplied to the surface of the photosensitive member, at an opposite side of the charger with the photosensitive member interposed therebetween.

7. The image forming apparatus according to claim 1, wherein a part of the process cartridge, which is positioned downstream to the first line in the mounting direction, is positioned at the opposite side of the exposure device with respect to the second line.

8. The image forming apparatus according to claim 1, wherein a substantially center of the exposure device, in the mounting direction, is positioned on the first line, at the state in which the process cartridge is mounted.

9. The image forming apparatus according to claim 1, wherein the pressing member is an elastic member that presses the rotation axis of the photosensitive member.

* * * * *